United States Patent [19]

Staub

[11] Patent Number: 4,945,562

[45] Date of Patent: Jul. 31, 1990

[54] X-RAY TARGET COOLING

[75] Inventor: Fred W. Staub, Schenectady, N.Y.

[73] Assignee: General Electric Company, Schenectady, N.Y.

[21] Appl. No.: 342,149

[22] Filed: Apr. 24, 1989

[51] Int. Cl.[5] ..... H01J 35/10

[52] U.S. Cl. ..... 378/130; 378/141

[58] Field of Search ..... 378/130, 141

[56] References Cited

U.S. PATENT DOCUMENTS 4,405,876 9/1983 Iversen ..... 378/130

4,622,687 11/1986 Whitaker et al. ..... 378/130

4,625,324 11/1986 Blaskis et al. ..... 378/130

*Primary Examiner*—Craig E. Church

*Attorney, Agent, or Firm*—William H. Steinberg; James C. Davis, Jr.; Paul R. Webb, II

[57] ABSTRACT

A rotatable anode for an X-ray tube is provided including a hollow rotatable anode wheel having two circular faces. One of the circular faces has a bevelled edge for a target region. A circular baffle is situated concentrically inside the hollow anode wheel. The baffle has means for imparting a tangential velocity to a liquid. The outer perimeter of the circular baffle is spaced away from the interior of the anode wheel. Means for supplying cooling liquid to the central portion of one side of the baffle is provided as well as means for removing cooling liquid from the other side of the baffle. Structural means are provided for rotating the baffle and the anode wheel at the same angular velocity.

10 Claims, 3 Drawing Sheets

21
23
24
25
27

X-RAY TARGET COOLING

CROSS REFERENCE TO RELATED APPLICATIONS

The present invention is related to copending application Ser. No. 177,234 filed Apr. 14, 1988 and assigned to the same assignee as the present invention.

BACKGROUND OF THE INVENTION

The present invention is related to liquid cooling of a rotating X-ray target in an X-ray tube.

High powered X-ray devices of the type used in such fields as medical diagnostics and X-ray crystallography require an anode capable of dissipating a relatively large amount of heat. Since the primary mode of dissipating this heat is by radiative heat transfer from the anode, an increase in the radiating surface area, leads to greater heat dissipation. By rotating the anode, a fresh area of the target surface can be continuously presented to the beam of electrons emitted by the cathode and the heat generated during X-ray production can be advantageously spread over a larger area. Thus, anode rotation allows an X-ray device to be operated at generally higher power levels than a stationary anode device and the problem of target surface degradation found in devices that use a stationary anode is avoided, provided the temperature limits of the target surface material are not exceeded.

The amount of heat generated and the temperatures achieved by an X-ray device can be substantial. Since less than 0.5% of the energy of the electron beam is converted into X-rays, while a major portion of the remaining energy emerges as heat, the average temperature of the target surface of the rotatable anode can exceed 1200° C. with peak hot spot temperatures being substantially higher. The reduction of these temperatures and dissipation of the heat is critical to any increase in power. The ability to dissipate the generated heat by anode rotation alone, however, is nonetheless limited. As a consequence, even though there has been a demand for ever higher-powered devices since rotatable anodes were first introduced, the development of such devices has lagged.

A further disadvantage of prior art devices is their limited lifetime, which is determined in part by their ability to dissipate heat. Since X-ray devices can be relatively expensive, extending the lifetime of such a device will result in substantial cost savings.

The time averaged heat dissipation of the X-ray tube used in a CT scanner determines the patient throughput. Present day CT scanner tubes dissipate approximately 3 kw. When the target of the X-ray tube overheats, as will happen if patient throughput is increased, the time between subsequent uses of the machine will have to be increased to allow the target to cool. An X-ray tube with higher heat dissipation will allow improved machine utilization.

When heated rotating discs need to be internally cooled to avoid temperatures that exceed design limits, direct liquid cooling can provide maximum heat removal. To maximize the heat transfer coefficients from the surface of the rotating anode, to the hollow interior of the anode very small passages carrying large coolant flows at high velocity is often not practical. Further, when it is desirable to use dielectric fluids whose heat removal capabilities are below that of water, the resulting heat transfer coefficients using conventional approaches are often too low.

It is an object of the present invention to provide a high intensity rotating X-ray target with high heat transfer coefficients over all internal surfaces to allow the use of a dielectric coolant.

It is another object of the present invention provide a high intensity X-ray tube target which does not require high coolant flow rates and complicated small coolant passage design.

SUMMARY OF THE INVENTION

In one aspect of the present invention a rotatable anode for an X-ray tube is provided including a hollow rotatable anode wheel having two circular faces. One of the circular faces has a bevelled edge for a target region. A circular baffle is situated concentrically inside the hollow anode wheel. The baffle has means for imparting a tangential velocity to a liquid. The outer perimeter of the circular baffle is spaced away from the interior of the anode wheel. Means for supplying cooling liquid to the central portion of one side of the baffle is provided as well as means for removing cooling liquid from the other side of the baffle. Structural means are provided for rotating the baffle at the same angular velocity as the anode wheel.

In another aspect of the present invention a method of cooling a hollow rotatable anode having a coolant passageway extending radially outwardly to the periphery of the hollow anode along one interior face and radially inwardly along the other interior face having the X-ray target is provided. The tangential velocity of the rotating anode is imparted to the cooling liquid entering the anode near the center of the anode. The pressure created in the radially outwardly flowing liquid is selected to avoid boiling of the liquid. The pressure created in the radially inwardly flowing liquid is selected to allow nucleate boiling in the region beneath the X-ray target.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the accompanying drawing figures in which:

FIGS. 3–6 are isometric views of just the baffle portion of the rotating anode with different vane configurations for controlling coolant flow in accordance with the present invention.

DETAILED DESCRIPTION OF THE INVENTION

Figure 1:
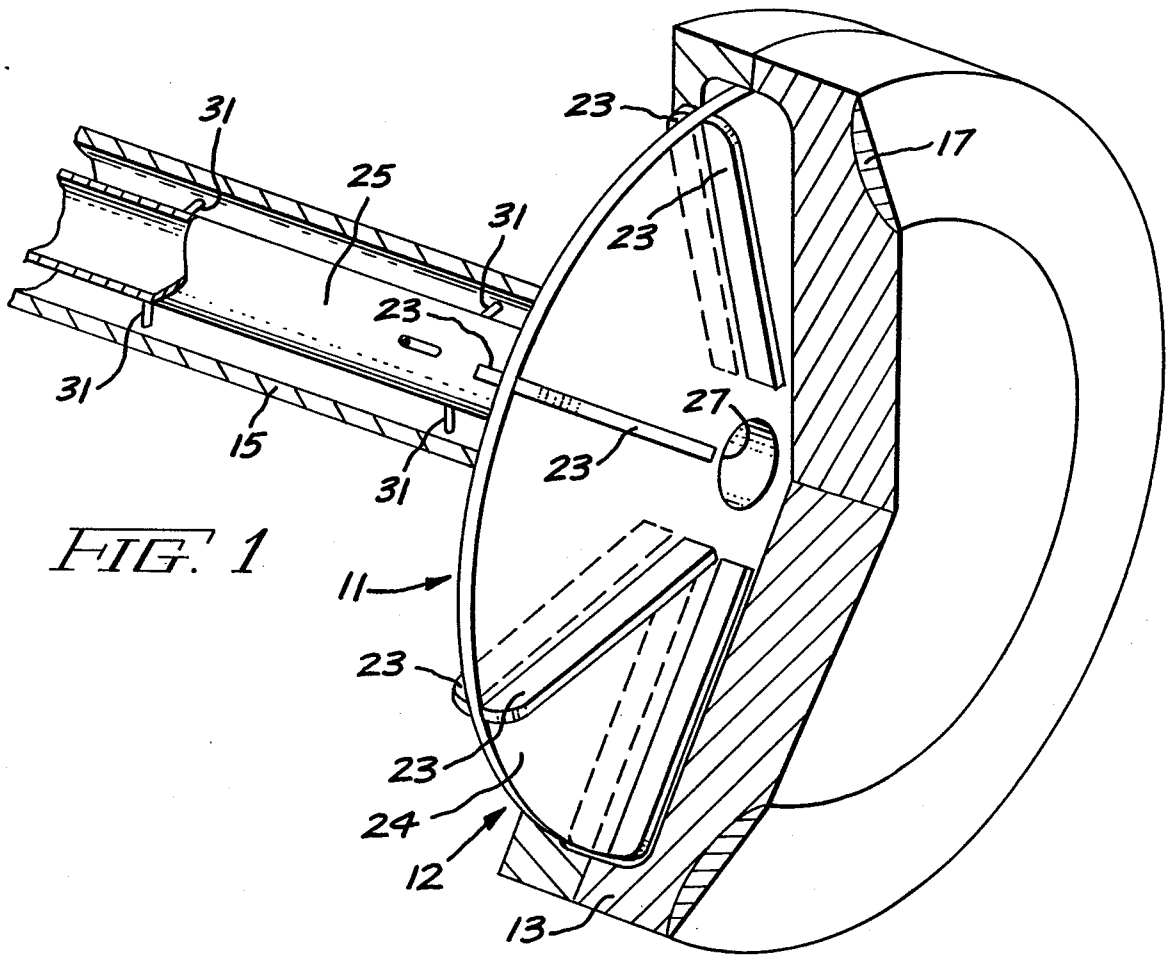
FIG. 1 is a partially cutaway isometric view of rotating anode X-ray tube target in accordance with the present invention.
Figure 2:
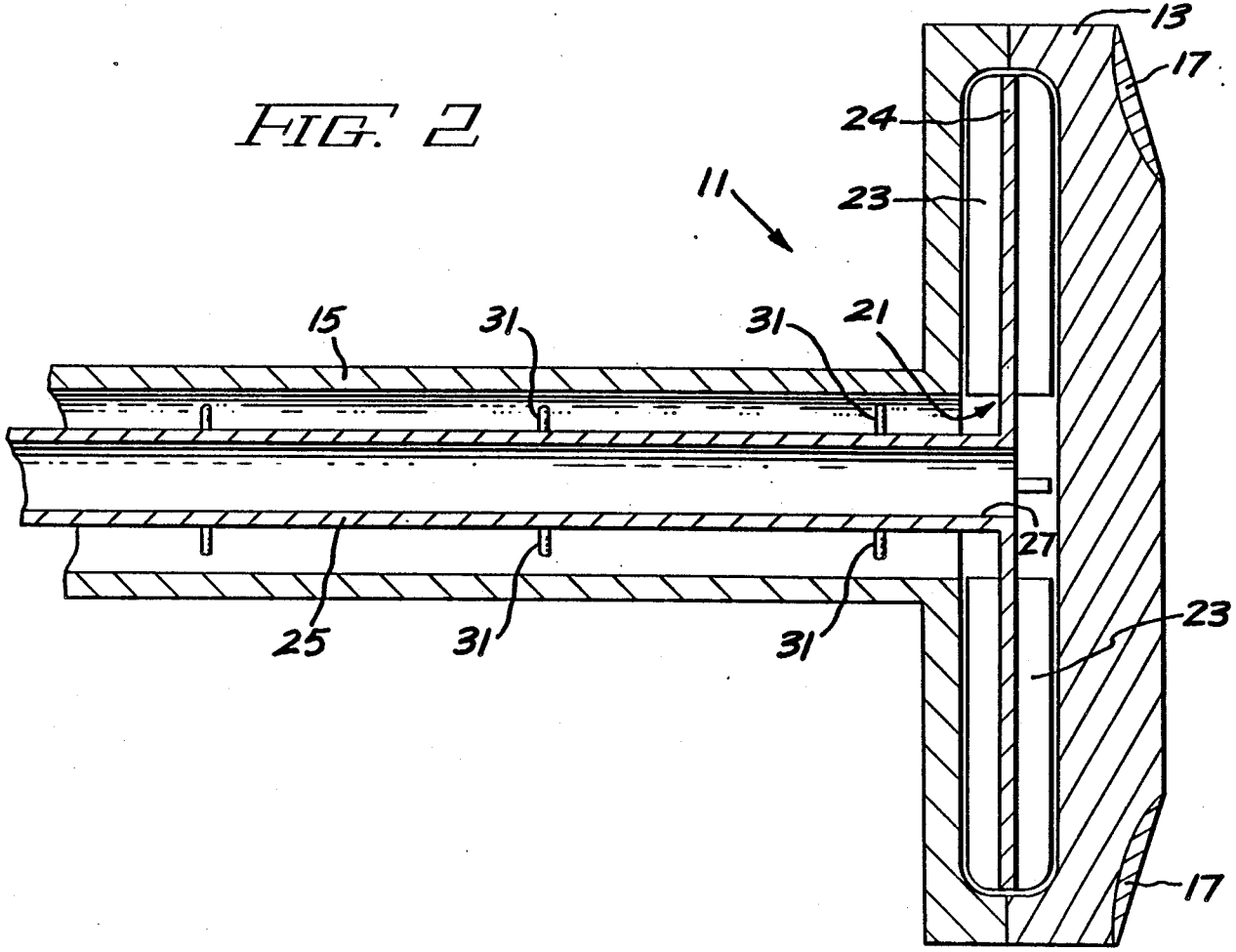
FIG. 2 is a sectional side view of the rotating anode X-ray tube target of FIG. 1.

Referring now to the drawing wherein like elements are indicated by like numeral throughout and more particularly FIGS. 1 and 2 thereof, an X-ray tube rotating anode 11 is shown. The anode comprises a hollow wheel fabricated from molybdenum mounted on a hollow shaft 15 extending from one side of the wheel. The hollow wheel can be fabricated in two parts joining along an axial centerline. The two parts can be joined using electron beam welding, for example. The interior of the shaft and wheel are in flow communication with one another. The other side of the wheel has a bevelled edge with target material plasma sprayed in an annular pattern to create a target 17 at the outer portion of the circular disc face. The annular target surface can comprise a tungsten alloy. Situated inside the hollow wheel is a disc shaped divider baffle 21 having a plurality of radially extending vanes 23 situated symmetrically on either side of a disc 24. The vanes can be secured to the disc such as by brazing. While eight vanes are shown on either side of the disc 4–16 vanes can typically be used. The baffle 21 is supported by a hollow shaft 25 surrounding a central aperture 27 formed in baffle 21 located inside shaft. Shaft 25 is supported concentrically in shaft 15 by spacers 31. The disc portion 24 of the baffle 21 and the vanes 23 do not have to be bonded to any portion of the wheel 13 interior to simplify fabrication of the anode. If desired, the vanes can be welded to the wheel interior. The wheel and the baffle rotate as a single unit since the two shafts 15 and 25 are secured to one another by spacers 31. The baffle and shafts can be fabricated from any suitable heat resistant material such as stainless steel.

In operation, the annular passageway formed between the exterior of shaft 25 and the interior of shaft 15 provides an inlet passageway for coolant. The coolant can advantageously be the same dielectric fluid used to cool the exterior of the X-ray tube (not shown) or any compatible dielectric coolant. The coolant is provided by a pump (not shown) through the aperture formed between shaft 25 and shaft 15. The coolant is then deflected by the baffle 21 and flows radially outwardly, with the tangential fluid velocity of the coolant insured by the vanes 23 of the baffle. The coolant upon entering the spinning wheel 13 flows radially outwardly on one side of the baffle to the edge of the baffle and around the outer edge. The coolant then flows radially inwardly on the other side of the baffle through the opening 27 in the center of the baffle and out through hollow shaft 25. Free convection heat transfer, nucleate boiling heat transfer, and maximum allowable boiling heat flux in nucleate boiling, increase with increasing acceleration. Since the maximum heating rate is encountered near the disc periphery due electron beam impingent near the periphery on the target 17 and since it is desirable to prevent film boiling at the periphery due to the low heat transfer coefficients associated with film boiling, a combination of rotating disc speed and disc diameter can be selected that will allow the peripheral portion of the interior of the wheel to be above the critical pressure of the coolant and thus avoid any boiling while allowing high free convection coefficients. While this would achieve maximum heat removal, operation above critical pressure is not necessary if the local wall temperature is below the saturation temperature of the coolant. The vanes are selected to cause the incoming coolant to absorb heat and not boil when flowing radially outwardly and to be allowed to boil while flowing radially inwardly on the other side of the baffle. This prevents boiling at the disc periphery and allows the high free convection coefficients needed at the disc periphery. On the radial inflow side of the baffle a boiling mode can begin, which allows the high nucleate boiling heat transfer coefficients to occur. The maximum nucleate boiling heat flux is pressure dependent. The radial pressure distribution is controlled by the tangential coolant velocity as determined by the vane design for a given diameter and rotational speed. This allows the heat flux to be held below the maximum nucleate boiling heat flux. Subcooled boiling is desirable to prevent net vapor formation during the radial inward flow which would prevent local pressure control. It also further, increases the maximum nucleate boiling heat flux. Subcooled boiling occurs when the average temperature of the liquid is below the saturation temperature for the given pressure, allowing the vapor generated during nucleate boiling adjacent the hot wheel interior walls to be condensed by the cooler liquid in the flow.

A suitable dielectric fluid can be a completely fluorinated organic compound such as the ones sold under the trademark FLUORINERT by 3M. The pressure at the critical point for FLUORINERT 75 is 234 psia. This pressure can be achieved in the interior of a hollow anode having a diameter 5 gpm at 12 kw level of 3.5 in, spinning at 10,000 rpm, flow rates of 5 gpm at nominal fluid pressure of 60-100 psig for operation at the 12 kw level.

Flow rates through the anode are selected to keep the exiting coolant from the anode wheel subcooled. Substantial flow rates are not required to achieve high heat transfer coefficients.

If boiling were to begin on the radial outflow side or at the periphery, where the fluid goes from one side of the baffle to the other, flow instabilities would make flow control difficult and film boiling would be likely to occur in the region beneath the circle traced by the electron beam on the target greatly reducing heat transfer to the liquid. If boiling is avoided entirely on the outflow side of the baffle the maximum heat transfer to the liquid may not be achieved.

Referring now to FIG. 3 an alternate vane configuration for baffle 21 is shown. In order to increase heat transfer from the wheel to the coolant in the region where the maximum heat input to the target occurs, it is desirable to extend the region where the pressure is within a range of plus or minus 10% of the critical pressure. The critical point can be defined as the intersection of the saturated liquid line and saturated vapor line on a temperature volume diagram for a substance showing liquid and vapor phases. At the critical point the coexisting saturated liquid and saturated vapor states are identical. The temperature, pressure, and specific volume at the critical point are called the critical temperature, critical pressure and critical volume. In the vicinity of the critical point the heat transfer coefficient has a very sharp peak. Heat transfer near the critical point is taken to include boiling just below the critical pressure and convection just above. The radial pressure gradient in the anode wheel of the cooling liquid depends on whether there is a forced or free vortex flow, with a forced vortex flow creating a higher pressure. In a region without vanes, a free vortex flow can exist. Vanes extending from the disc to the wheel create a forced vortex during wheel rotation. As seen in FIG. 3, to extend the region where the peak heat transfer occurs, the vanes are trimmed to achieve a radial extending region where the pressure variations are changed to take better advantage of the high heat transfer coefficients in the vicinity of the critical point. The pressure variations due to the trimmed vanes cause operation between the forced and free vortex modes of operation. Typically the greatly improved heat transfer coefficients exist within the range of plus or minus 10% of the critical pressure.

Figures 4, 5, 6:
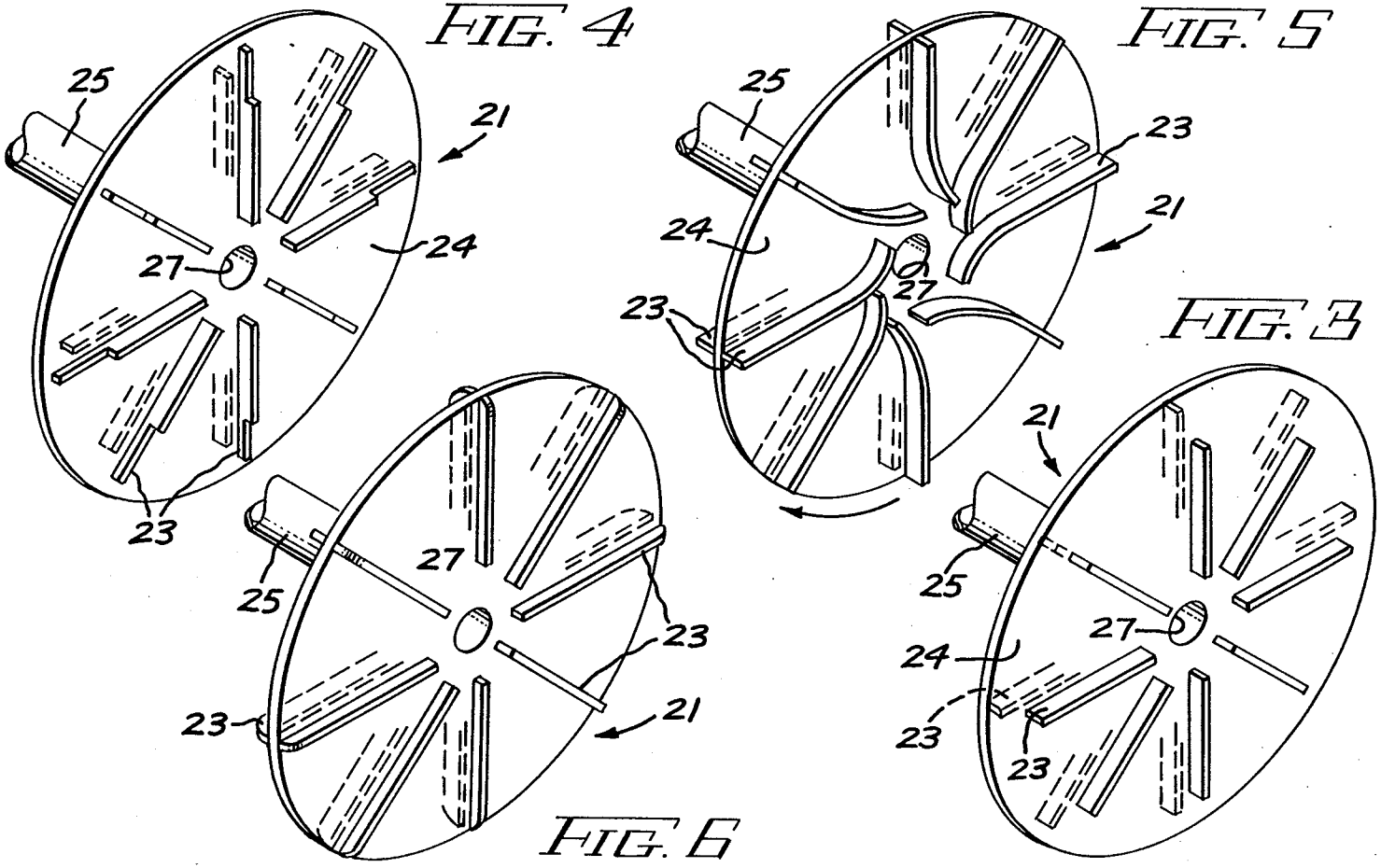

Referring now to FIG. 4, another embodiment of a vane configuration for tailoring the pressure variation in the radial direction in the vicinity of the critical pressure is shown. The vanes 23 are shown trimmed on the inflow and outflow side of the baffle 21.

Referring now to FIG. 5 the vanes 23 near the center of the baffle 21 are shown curved to accelerate the liquid velocity relative to the vane surface for improved heat transfer and to avoid backflow due to the interaction of the vanes with the secondary circulation of the coolant.

FIG. 6 shows another embodiment of the baffle 21 in which the distance between the baffle and the interior of the wheel on the inflow and outflow sides are unequal. The distance between the outflow side and the interior of the wheel being narrower than the distance between the inflow side of the baffle and the interior of the wheel. The narrower gap helps to reduce backflow at the exit of the coolant into shaft by increasing the radial velocity of the coolant The foregoing has described a high intensity rotating X-ray target with high heat transfer coefficients over all internal surfaces to allow the use of a dielectric coolant.

While the invention has been particularly shown and described with reference to several embodiments thereof, it will be understood by those skilled in the art that various changes in form and detail may be made without departing from the spirit and scope of the invention.

What is claimed is:

1. A rotatable anode for an X-ray tube comprising:

a hollow rotatable anode wheel having two circular faces, one of said faces having a bevelled edge for a target region;

a circular baffle having first and second sides situated concentrically inside said hollow anode wheel, said circular baffle having means for imparting a tangential velocity to a liquid on either side of the baffle, the outer perimeter of said circular baffle spaced away from the interior of said anode wheel said second side of said circular baffle having means situated thereon for creating operation between a forced and a free vortex condition in liquid in the vicinity of the disc periphery;

means for supplying cooling liquid to the central portion of the first side of said baffle;

means for removing cooling liquid from the central portion of the second side of said baffle, said second side of said baffle adjacent to the face of said hollow rotatable anode wheel having the bevelled edge; and structural means for rotating said baffle when said anode wheel is being rotated.

2. The rotatable anode of claim 1 wherein said baffle is situated closer to the anode wheel face having the bevelled edge than to the other anode wheel face.

3. A rotatable anode for an X-ray tube comprising;

a hollow rotatable anode wheel having two circular faces, one of said faces having a bevelled edge for a target region;

a circular baffle having first and second sides situated concentrically inside said hollow anode wheel, said circular baffle having means for imparting a tangential velocity to a liquid on either side of the baffle including radially extending vanes on either side of said circular baffle, the outer perimeter of said circular baffle spaced away from the interior of said anode wheel;

means for supplying cooling liquid to the central portion of the first side of said baffle;

means for removing cooling liquid from the central portion of the second side of said baffle, said second side of said baffle adjacent to the face of said hollow rotatable anode wheel having the bevelled edge; and structural means for rotating said baffle when said anode wheel is being rotated.

4. The rotatable anode of claim 3 further comprising means for creating operation between a forced and free vortex condition on the second side of the circular baffle wherein the vanes extend a shorter perpendicular distance from the baffle on the second side of the baffle in the vicinity of the bevelled edge of the rotatable anode than do vanes situated elsewhere on the second side of the baffle.

5. A rotatable anode for an X-ray tube comprising:

a hollow rotatable anode wheel having two circular faces, one of said faces having a bevelled edge for a target region, the other of said faces defining a central aperture;

a first hollow shaft secured to said other face around said central aperture, the interior of said shaft in flow communication with the interior of said anode wheel;

a circular baffle having a central aperture situated concentrically inside said hollow anode, said circular baffle having a plurality of vanes on either side of said baffle and secured to said baffle for imparting a tangential velocity to a cooling fluid, the outer perimeter of said circular baffle spaced away from the interior of said anode wheel;

a second hollow shaft situated inside said first shaft, said second shaft secured to said baffle around said central aperture of said baffle; and structural means for rotating said baffle at the same speed as said anode wheel.

6. The rotatable anode of claim 5, wherein said structural means is secured between said first and second shafts.

7. The rotatable anode of claim 5, wherein said vanes are spaced away from the interior of said anode wheel.

8. The rotatable anode of claim 5, wherein said vanes extend radially along the circular baffle and extend perpendicular therefrom, said vanes equally spaced circumferentially from one another.

9. The rotatable anode of claim 8 wherein said vanes on said baffle situated in close proximity to the bevelled edge of said anode wheel extend a shorter perpendicular distance from the baffle side, than do the vanes elsewhere on the baffle, thereby creating a region where the radial pressure variations can be adjusted.

10. The rotatable anode of claim 5 wherein the portion of the vanes situated near the center of the baffle on at least one side of the baffle curve in the direction of anode rotation so that the relative velocity of the coolant can be increased.

* * * * *